US008911879B2

(12) United States Patent
Shimoda et al.

(10) Patent No.: US 8,911,879 B2
(45) Date of Patent: Dec. 16, 2014

(54) HOT-DIP ZN—AL—MG—SI—CR ALLOY-COATED STEEL MATERIAL WITH EXCELLENT CORROSION RESISTANCE

(75) Inventors: Nobuyuki Shimoda, Tokyo (JP); Yasuhide Morimoto, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 279 days.

(21) Appl. No.: 13/138,175

(22) PCT Filed: Jan. 14, 2010

(86) PCT No.: PCT/JP2010/050658
§ 371 (c)(1),
(2), (4) Date: Jul. 14, 2011

(87) PCT Pub. No.: WO2010/082678
PCT Pub. Date: Jul. 22, 2010

(65) Prior Publication Data

US 2011/0274945 A1 Nov. 10, 2011

(30) Foreign Application Priority Data

Jan. 16, 2009 (JP) ..... 2009-008100

(51) Int. Cl.

| | |
|---|---|
| ***B32B 15/01*** | (2006.01) |
| ***B32B 15/04*** | (2006.01) |
| ***B32B 15/18*** | (2006.01) |
| ***B32B 15/20*** | (2006.01) |
| ***B05D 1/18*** | (2006.01) |
| ***B05D 3/00*** | (2006.01) |
| ***C23C 2/12*** | (2006.01) |
| ***C23C 2/06*** | (2006.01) |
| ***C23C 2/26*** | (2006.01) |

(52) U.S. Cl.
CPC ... *C23C 2/06* (2013.01); *C23C 2/12* (2013.01); *C23C 2/26* (2013.01)
USPC ..... 428/659; 428/653; 427/398.1; 427/431; 427/433; 427/436

(58) Field of Classification Search
USPC ..... 428/650, 653, 610, 659, 658, 682, 683, 428/684, 685, 213, 215, 216, 220, 332, 336
See application file for complete search history.

(56) References Cited

U.S. PATENT DOCUMENTS 4,877,494 A 10/1989 Kanamaru et al.
4,897,317 A 1/1990 Kanamaru et al.

(Continued)

FOREIGN PATENT DOCUMENTS

CN 1531604 9/2004
EP 1225246 7/2002

(Continued)

OTHER PUBLICATIONS

European Search Report dated May 10, 2012, issued in corresponding European Application No. EP 10731347.

(Continued)

*Primary Examiner* — Michael E La Villa
(74) *Attorney, Agent, or Firm* — Kenyon & Kenyon LLP

(57) ABSTRACT

The present invention provides a Zn—Al—Mg—Cr alloy-coated steel material with excellent corrosion resistance. A molten Zn—Al—Mg—Si—Cr alloy-coated steel material which is a steel material having a Zn—Al—Mg—Cr alloy coating layer and which has an interfacial alloy layer formed of coating layer components and Fe at the coating layer-steel material interface, wherein the interfacial alloy layer has a multilayer structure consisting of an Al—Fe-based alloy layer and an Al—Fe—Si-based alloy layer and furthermore, the Al—Fe—Si-based alloy layer contains Cr.

15 Claims, 5 Drawing Sheets

(56) References Cited

U.S. PATENT DOCUMENTS

| | | | | |
|---|---|---|---|---|
| 6,465,114 | B1 * | 10/2002 | Honda et al. | 428/659 |
| 2009/0053555 | A1 | 2/2009 | Nose et al. | |
| 2009/0142616 | A1 | 6/2009 | Fujii | |
| 2010/0304183 | A1 | 12/2010 | Honda et al. | |

FOREIGN PATENT DOCUMENTS

| | | |
|---|---|---|
| EP | 1930463 | 6/2008 |
| JP | 58-181855 | 10/1983 |
| JP | 2-46442 | 10/1990 |
| JP | 6-99836 | 12/1994 |
| JP | 2002-212699 | 7/2002 |
| JP | 2002-356759 | 12/2002 |
| JP | 2003-277905 | 10/2003 |
| JP | 2004-176131 | 6/2004 |
| JP | 2005-264188 | 9/2005 |
| KR | 10-2008-0031990 | 4/2008 |
| TW | 392764 | 1/2006 |
| TW | 354706 | 3/2006 |
| TW | 354706 | 12/2011 |
| WO | 02/103073 | 12/2002 |
| WO | 2007/006426 | 1/2007 |

OTHER PUBLICATIONS

International Search Report dated Feb. 16, 2010 issued in corresponding PCT Application No. PCT/JP2010/050658.

* cited by examiner

HOT-DIP ZN—AL—MG—SI—CR ALLOY-COATED STEEL MATERIAL WITH EXCELLENT CORROSION RESISTANCE

This application is a national stage application of International Application No. PCT/JP2010/050658, filed Jan. 14, 2010, which claims priority to Japanese Application No. 2009-008100 filed Jan. 16, 2009, which is incorporated by reference in its entirety.

TECHNICAL FIELD

The present invention relates to a hot-dip Zn-based coated steel material used for application to building materials, automobiles and home electric appliances. More specifically, the present invention relates to hot-dip Zn—Al—Mg—Si—Cr alloy coating with excellent corrosion resistance yielding a high corrosion-resistance performance required mainly in the building material application.

BACKGROUND ART

It has been heretofore widely known to improve corrosion resistance of a steel material by applying Zn coating to the steel material surface, and a steel material subjected to Zn coating is being mass-produced at present. However, in many applications, corrosion resistance imparted only by Zn coating may be insufficient. Therefore, as a steel material is more enhanced in the corrosion resistance than by Zn, a hot-dip Zn—Al alloy-coated steel sheet (Galvalume Steel Sheet (registered trademark)) is being used. For example, the hot-dip Zn—Al alloy coating disclosed in Patent Document 1 is performed by applying an alloy coating composed of Al in a concentration of 25 to 75 mass % and Si in a concentration of 0.5% or more of the Al content, with the balance being substantially Zn, where a hot-dip Zn—Al alloy coating layer not only being practically excellent in corrosion resistance but also having good adherence to a steel material and good-looking appearance is obtained.

As another method for enhancing the corrosion resistance of Zn, Zn—Cr-based alloy coating of adding Cr to the coating layer has been proposed. The Zn—Cr alloy coating disclosed in Patent Document 2 is applied, as a coating layer, a Zn—Cr-based alloy electrocoating layer composed of Cr in a concentration of more than 5% and 40% or less, with the balance being Zn, where excellent corrosion resistance is obtained compared with a steel sheet subjected to conventional Zn-based coating.

Patent Document 3 discloses a technique where as a result of adding various alloy elements to a coating based on Zn-55% Al that is the coating composition of Galvalume Steel Sheet and studying the addable amount thereof or the corrosion resistance-enhancing effect by the addition, a coating containing Al: 25 to 75 mass % can contain Cr in a concentration of about 5 mass % and the corrosion resistance can be remarkably enhanced by containing Cr. This is a technique of increasing the corrosion resistance by forming a Cr-concentrated layer at the interface.

Also in Patent Document 4, various alloy elements are added to a coating based on Zn-55% Al that is the coating composition of Galvalume Steel Sheet, and the addable amount thereof or the corrosion resistance-enhancing effect by the addition is studied, where in particular, a technique of enhancing the bending processability by optimizing the spangle size of coating is disclosed.

Furthermore, Patent Document 5 also discloses a technique of enhancing the processability by controlling the particle size of an interfacial alloy layer formed by coating with the Galvalume composition.

RELATED ART

Patent Document (Patent Document 1) Japanese Patent No. 1,617,971
(Patent Document 2) Japanese Patent No. 2,135,237
(Patent Document 3) Kokai (Japanese Unexamined Patent Publication) No. 2002-356759
(Patent Document 4) Kokai No. 2005-264188
(Patent Document 5) Kokai No. 2003-277905

SUMMARY OF THE INVENTION

Problems to be Solved by the Invention

In Patent Document 1, the corrosion resistance is significantly excellent compared with a steel material subjected to conventional Zn-based coating but is insufficient to meet the recent requirement for more enhancing the corrosion resistance mainly in the building material application field.

In Patent Document 2, since a Zn—Cr alloy coating film is deposited by an electrocoating method, the element is limited to an element capable of electrocoating and this imposes a restriction on more enhancement of the corrosion resistance, as a result, the corrosion resistance is insufficient.

Patent Document 3 may be an innovative method but is still insufficient in terms of enhancement of corrosion resistance. Particularly, the anticorrosion function of the interfacial alloy layer when corrosion of the coating has proceeded is insufficient and the function of Cr added is far from being fully exerted. Similarly to Patent Document 2, a sufficiently high effect of enhancing the corrosion resistance cannot be obtained.

In Patent Document 4, the structure of the interfacial alloy layer is not controlled and the processability is poor. The processability is in fact enhanced by a warming treatment and this disadvantageously requires time-consuming.

Patent Document 5 gets further into the structure of the interfacial alloy layer to compensate for the shortcoming above, but satisfactory processability is hardly achieved because the Si amount greatly affecting the interface structure is small and the structure is single.

An object of the present invention is to solve those problems and provide a hot-dip Zn—Al-based alloy-coated steel material having excellent bending processability and high corrosion resistance greatly surpassing those of the conventional techniques.

Means to Solve the Problems

The present inventors have studied on the combination use of Al and Cr and the expression of effective performance of Cr by adding Mg or Cr to coating based on Zn-55% Al like Galvalume composition and further variously examining the coating conditions and have found that the distribution state of Cr in the interfacial alloyed layer is very closely related to the corrosion resistance and for enhancing the corrosion resistance, it is important to control the distribution state. Based on this knowledge, the gist of the present invention resides in the following (1) to (7).

(1) A hot-dip Zn—Al—Mg—Si—Cr alloy-coated steel material having a coating layer on the surface of a steel material and having an interfacial alloy layer at the interface between the steel material and the coating layer, wherein the average composition of the entire coating layer consisting of the coating layer and the interfacial alloy layer contains, in mass %, Al: from 25 to 75%, Mg: from 0.1 to 10%, Si: more than 1% and 7.5% or less, and Cr: from 0.05 to 5.0%, with the balance being Zn and unavoidable impurities, the interfacial alloy layer is composed of coating layer components and Fe and has a thickness of 0.05 to 10 μm or a thickness of 50% or less of the entire coating layer thickness, the interfacial alloy layer has a multilayer structure consisting of an Al—Fe-based alloy layer and an Al—Fe—Si-based alloy layer, and the Al—Fe—Si-based alloy layer contains Cr.

(2) The hot-dip Zn—Al—Mg—Si—Cr alloy-coated steel material as described in (1), wherein the Al—Fe—Si-based alloy layer consists of a layer substantially containing Cr and a layer substantially not containing Cr and the Cr-containing layer is in contact with the coating layer.

(3) The hot-dip Zn—Al—Mg—Si—Cr alloy-coated steel material as described in (1) or (2), wherein the Al—Fe-based alloy layer forms a columnar crystal and the Al—Fe—Si-based alloy layer forms a granular crystal.

(4) The hot-dip Zn—Al—Mg—Si—Cr alloy-coated steel material as described in any one of (1) to (3), wherein the Al—Fe-based alloy layer consists of two layers, i.e., a layer composed of $Al_5Fe_2$ and a layer composed of $Al_{3.2}Fe$.

(5) The hot-dip Zn—Al—Mg—Si—Cr alloy-coated steel material as described in any one of (1) to (4), wherein the Cr concentration in the Cr-containing Al—Fe—Si-based alloy layer is from 0.5 to 10% in terms of mass %.

(6) The hot-dip Zn—Al—Mg—Si—Cr alloy-coated steel material as described in any one of (1) to (5), wherein the entire coating layer contains, in mass %, from 1 to 500 ppm of at least one kind of an element out of Sr and Ca.

(7) A method for producing the hot-dip Zn—Al—Mg—Si—Cr alloy-coated steel material described in any one of (1) to (6), comprising steps of:

dipping and then pulling a steel material in and out of a hot-dip coating bath containing, in mass %, Al: from 25 to 75%, Mg: from 0.1 to 10%, Si: more than 1% and 7.5% or less, and Cr: from 0.05 to 5.0%, with the balance being Zn and unavoidable impurities, to obtain a coated steel material, cooling the pulled-up coated steel material from the coating bath temperature to the solidification temperature of the coating at a cooling rate of 10 to 20° C./sec to solidify the coating, and cooling the coated steel material after solidification of the coating, at a cooling rate of 10 to 30° C./sec to form an Al—Fe—Si-based alloy layer containing the Cr in the interfacial alloy layer formed between the steel material and the coating layer.

Effects of the Invention

According to the present invention, a hot-dip Zn—Al—Mg—Cr alloy-coated steel material excellent in processability and corrosion resistance can be provided. This steel material can be widely applied to automobiles, buildings/houses and the like and greatly contributes to industrial growth by serving, for example, the enhancement of member life-time the effective utilization of resources, the alleviation of environmental load, and the reduction in maintenance costs.

MODE FOR CARRYING OUT THE INVENTION

Figure 1:
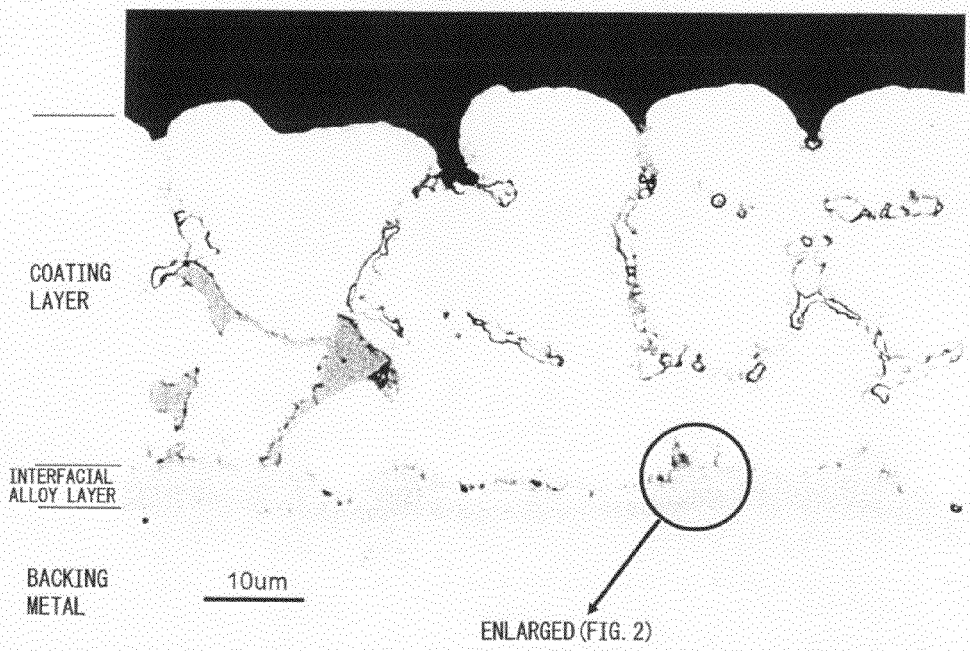
FIG. 1 is a cross-sectional photograph of the coated steel material of the present invention.

The present invention is described in detail below.

In the description of the present invention, unless otherwise indicated, the "%" indication in the composition means "mass %". Also, in the present invention, the coating layer is discriminated from the interfacial alloy layer. The "entire coating layer" is used for indicating the coating layer as a whole including the interfacial alloy layer. Accordingly, the "coating layer components" as used in the present invention refers to the components of only the coating layer not including the interfacial alloy layer, but the coating layer as a whole including the interfacial coating layer is sometimes simply referred to as a "coating layer".

The hot-dip Zn—Al—Mg—Cr alloy-coated steel material with excellent corrosion resistance of the present invention is characterized by having an interfacial alloy layer at the interface between the steel material and the coating layer, wherein the average composition of the entire coating layer consisting of the coating layer and the interfacial alloy layer contains, in mass %, Al: from 25 to 75%, Mg: from 0.1 to 10%, Si: more than 1% and 10% or less, and Cr: from 0.05 to 5.0%, with the balance being Zn and unavoidable impurities, the interfacial alloy layer is composed of coating layer components and Fe and has a thickness of 0.05 to 10 μm or a thickness of 50% or less of the entire coating layer thickness, the interfacial alloy layer has a multilayer structure consisting of an Al—Fe-based alloy layer and an Al—Fe—Si-based alloy layer, and the Al—Fe—Si-based alloy layer contains Cr. Here, the steel material is a ferrous material such as steel sheet, steel pipe and steel wire.

In the coated steel material of the present invention, the coating composition is expressed by the average composition (excluding Fe) of the entire coating layer as the coating layer including the interfacial coating layer, and the chemical components of the entire coating layer can be obtained as an average of the total composition of the coating layer and the interfacial alloy layer by dissolving the coating layer (including the interfacial alloy layer) present on the steel material surface and chemically analyzing the solution.

Cr is preferably allowed to be present in a concentrated manner in the interfacial alloy layer formed between the coating layer and the steel substrate. The Cr concentrated in the interfacial alloy layer is considered to suppress the corrosion of the steel substrate and enhance the corrosion resistance by the passivation action of Cr in the stage of the coating layer dissolving to expose a part of the steel substrate surface with the progress of corrosion. Out of the interfacial alloy layer, the effect of an element forming a dense oxide film, such as Al and Si, can be more increased in a region closer to the coating layer.

Also, the interfacial alloy layer contains Fe and therefore, produces red rust by corrosion. The red rust is least desired and thanks to the presence of Cr on the coating layer side of the interfacial alloy layer, generation of red rust can be also suppressed. Furthermore, from the standpoint of more enhancing the corrosion resistance, a part of Cr is preferably concentrated and allowed to be present in the outermost surface layer of the coating layer. Since, Cr concentrated in the coating surface layer forms a passivation film and the effect above is considered to contribute to enhancement of the initial corrosion resistance of mainly the coating layer.

As for the composition of the entire coating layer, Cr is from 0.05 to 5%. If Cr is less than 0.05%, the effect of enhancing the corrosion resistance is insufficient, whereas if it exceeds 5%, there arises a problem such as increase in the amount of dross generated in the coating bath. In view of corrosion resistance, this element is preferably contained in a concentration of more than 0.2%.

As for the average composition of the entire coating layer, if Al in the coating layer is less than 25%, an interfacial alloy layer is not efficiently produced and Cr is hardly taken into the interfacial alloy layer. Also, the bare corrosion resistance decreases. On the other hand, if it exceeds 75%, the sacrificial corrosion protection or the corrosion resistance of the cut end face is reduced. Also, the temperature of the alloy coating bath needs to be maintained high and this causes a problem such as rise in the production cost. Accordingly, the Al concentration in the coating layer is set to be from 25 to 75%, preferably from 45 to 75%.

In the coated steel material of the present invention, Si has an effect of, at the formation of a coating layer on a steel material, preventing an Fe—Al-based alloy layer from being formed to an excessively large thickness at the interface between the steel substrate and the coating layer and enhancing the adherence of the coating layer to the steel material surface. As for the average composition of the entire coating layer, if Si is 1% or less, the effect of suppressing the production of an Fe—Al-based interfacial alloy layer is insufficient and rapid production of the interfacial alloy layer proceeds, which is inadequate for controlling the structure of the interfacial alloy layer. Furthermore, damage to a stainless steel-based underwater device is severe. Also, if this element is contained in excess of 7.5%, the effect of suppressing the formation of an Fe—Al-based interfacial alloy layer is saturated and at the same time, reduction in the processability of the coating layer may be incurred. For this reason, the upper limit is set to 7.5%. In the case of attaching importance to the processability of the coating layer, the upper limit is preferably 3%. The concentration is more preferably from 1.2 to 3%.

As for the average composition of the entire coating layer, by containing Mg in an amount of 0.1 to 10%, high corrosion resistance can be obtained. If this element is added in an amount of less than 0.1%, the effect of enhancing the corrosion resistance is not obtained, whereas if the amount added exceeds 10%, not only the effect of enhancing the corrosion resistance is saturated but also there arises a production problem such as increase in the amount of dross generated in the coating bath. From the production aspect, the amount added is preferably 5% or less, more preferably from 0.5 to 5%.

In the coating, an alkaline earth metal such as Sr may be added in an amount of 1 to 500 ppm to more enhance the corrosion resistance. In this case, if added in an amount of less than 1 ppm, the effect of enhancing the corrosion resistance is not obtained. Addition in an amount of 60 ppm or more is preferred. On the other hand, if the amount added exceeds 500 ppm, not only the effect of enhancing the corrosion resistance is saturated but also there are production problems such as increase in the amount of dross generated in the coating bath. The amount added is more preferably from 60 to 250 ppm.

As for the composition of the coating layer, the balance, except for Al, Cr, Si, Mg, Sr and Ca, is composed of zinc and unavoidable impurities. The unavoidable impurity as used herein means an element unavoidably mixed in the coating process, such as Pb, Sb, Sn, Cd, Ni, Mn, Cu and Ti. These unavoidable impurities may be contained in an amount of, as a total content, maximally about 1%, but the content thereof is preferably as small as possible, for example, preferably 0.1% or less.

The coating coverage is not particularly limited, but if the coating layer is too thin, the enhanced corrosion resistance by the coating layer is lacking, whereas if it is too thick, the bending processability of the coating layer is impaired and a problem such as generation of cracks may occur. Therefore, the coating coverage is, in total of both front and back surfaces of the steel material, preferably from 40 to 400 g/m$^2$, more preferably from 50 to 200 g/m$^2$.

The presence of the interfacial alloy layer can be confirmed by the cross-sectional TEM observation of the coating layer and the EDS analysis. When the interfacial alloy layer is formed to a film thickness of 0.05 μm or more, the effect by the formation is obtained. On the other hand, if the film thickness is too large, the bending processability of the coating layer is impaired. Therefore, the film thickness is preferably not more than a smaller value between 10 μm or less and 50% or less of the entire coating thickness.

As described above, by adding Si, the growth of an Al—Fe-based alloy can be suppressed and the adherence of the coating can be increased. The reason therefor is not clearly known, but it is presumed that the Al—Fe-based alloy grows as a columnar crystal and the Al—Fe—Si-based alloy grows as a granular crystal, allowing the granular crystal layer of Al—Fe—Si-based alloy to be present between the columnar crystal of Al—Fe-based alloy and the coating layer, as a result, the difference in stress at the interface of the interfacial alloyed layer with the coating layer is relieved to develop good adherence.

Also, the Al—Fe-based alloy layer growing as a columnar crystal is formed as a multilayer structure where the lower layer is composed of $Al_5Fe_2$ resulting from progress of alloying in a high Fe ratio and the upper layer is composed of $Al_{3.2}Fe$ with a low alloying degree, whereby more enhancement of coating adherence can be realized. The reason therefor is not clearly known but is presumed because formation of a multilayer structure brings about, for example, reduction in the internal stress of the layer itself or decrease in the stress difference at the layer interface.

Thanks to the multilayer configuration, cracks that may be generated during bending processing are stopped at each layer and prevented from being propagated. Therefore, the cracks are kept from leading to separation of the coating layer, and reduction in the corrosion resistance of the bending processed part is not caused.

The Al—Fe—Si-based alloy layer consists of a layer substantially containing Cr and a layer substantially not containing Cr, and the Cr-containing layer is preferably in contact with the coating layer. With respect to substantially containing or not containing Cr, the Cr content being 0.5% or more is defined as substantially containing Cr, because when the Al—Fe—Si-based alloy layer contains, in mass %, 0.5% or more of Cr, enhancement of the corrosion resistance due to passivation by Cr is brought out. If the Cr content is less than 0.5%, the effect above cannot be recognized, and therefore, the Cr content being less than 0.5% is defined as substantially not containing Cr. The upper limit of the Cr concentration in the Cr-containing Al—Fe—Si-based alloy layer is set to 10% because even if the concentration is higher than this, the effect of enhancing the corrosion resistance is saturated. Incidentally, the amounts of Cr and respective elements in the Al—Fe—Si-based alloy layer can be determined, for example, by an analysis such as TEM-EDS.

As described above, when Cr is present mainly on the coating layer side of the interfacial alloy layer, generation of red rust can be also suppressed. In the case of allowing Cr to be uniformly present in the Al—Fe—Si-based alloy layer, for ensuring the required Cr concentration, a large amount of Cr needs to be added to the coating bath. In this case, dross is generated in a large amount and operational difficulty increases. By concentrating Cr on the coating layer side of the Al—Fe—Si-based alloy layer, the effect of enhancing the corrosion resistance can be brought out without charging a large amount of Cr.

Also, when Cr is concentrated in the outermost surface layer of the interfacial alloy layer, even if cracks are present in the processed part, generation of red rust can be suppressed.

Formation of the interfacial alloy layer starts immediately after dipping the steel material to be coated in a hot-dip coating bath, solidification of the coating layer is thereafter completed, and the formation further proceeds until the temperature of the coating steel material lowers to about 400° C. or less. Accordingly, the thickness of the interfacial alloy layer can be controlled by adjusting, for example, the hot-dip bath temperature, the dipping time of the steel material to be coated, and the cooling rate after coating.

The conditions for forming a coating layer having an adequate interfacial alloy layer are not particularly limited, because optimal conditions vary depending on the kind of the target steel material, the coating bath components, the temperature of the coating bath, and the like. When the steel material is dipped in a hot-dip bath (molten metal bath) at a temperature approximately from 20 to 60° C. higher than the solidification temperature of the coating for 1 to 6 seconds and then cooled at a cooling rate of 10 to 20° C./sec, preferably from 15 to 20° C./sec, an alloy-coated steel material having an adequate interfacial alloy layer can be obtained. For example, in the case of an alloy composed of 55% Al—Zn-3% Mg-1.6% Si-0.3% Cr, the freezing point is about 560° C. and therefore, the steel material is preferably dipped in a molten metal bath at a bath temperature of (freezing point+20° C.) to (freezing point+60° C.), i.e., from 580 to 620° C., for 1 to 6 seconds. If the dipping time is less than 1 second, an initial reaction long enough to produce the interfacial alloy layer may not be ensured, whereas if it exceeds 6 seconds, the reaction proceeds more than necessary and an excessive Fe—Al alloy layer may be produced. The plate temperature at entering is adequately from 450 to 620° C. If the plate temperature is less than 450° C., the sufficient initial reaction may not be ensured, whereas if it exceeds 620° C., the reaction proceeds more than necessary and an excessive Fe—Al-based interfacial alloy layer may be produced. Thereafter, the steel material is cooled to the freezing point at a cooling rate of 10 to 20° C./sec, preferably from 15 to 20° C./sec, and further cooled to 350° C. from the freezing point at 10 to 30° C./sec, preferably from 15 to 30° C./sec, more preferably from 15 to 20° C./sec, whereby an alloy-coated steel material having an adequate interfacial alloy layer can be obtained.

If the cooling rate is higher than the range above, the objective alloy layer is not produced. If the cooling rate to the solidification is low, an excessive Fe—Al-based interfacial alloy layer is produced. If the cooling rate after solidification is lower than the range above, homogenization of the interfacial alloy layer proceeds and the objective multilayer structure is not obtained.

As for the alloy coating bath used in the present invention, the solidification temperature varies depending on the bath composition, but the temperature range is approximately from 450 to 620° C. Therefore, according to the solidification temperature with the components selected as described above, appropriate conditions are selected from the conditions that the temperature of bath for dipping is from 500 to 680° C., the dipping time in bath is from 1 to 6 seconds, the cooling rate until solidification is from 10 to 20° C./sec, preferably from 15 to 20° C./sec, and the cooling rate after solidification is from 10 to 30° C./sec, preferably from 15 to 30° C./sec, more preferably from 15 to 20° C./sec, whereby an alloy-coated steel material having an adequate interfacial alloy layer can be obtained.

Incidentally, for obtaining an adequate Cr concentration distribution in the interfacial alloy layer, control of particularly the cooling conditions is important. More specifically, Cr is considered to be almost uniformly distributed in the Al—Fe—Si-based alloy layer immediately after the production of the Al alloy layer and in the cooling process after solidification, be concentrated at a specific portion in the Al—Fe—Si-based alloy layer.

The mechanism of concentrating Cr is not known but may be considered as follows, though the present invention is not bound by any theory. The coating starts being solidified from the surface layer and is finally solidified in the vicinity of the steel material-coating interface, and at this time, solidification proceeds while allowing Cr to be concentrated on average in the vicinity of the steel substrate-coating interface. Thereafter, Si and Cr are pushed up by Fe diffusing from the steel substrate and move to the surface direction, and the interfacial alloy layer is separated into an Al—Fe layer in the lower part and an Al—Fe—Si-based alloy layer in the upper part. In the Al—Fe—Si-based alloy layer, Cr is further pushed up and more concentrated in the uppermost layer part of the Al—Fe—Si-based alloy layer.

Therefore, if the cooling rate after solidification of the coating is too low, the interfacial alloy layer itself becomes excessively thick before Cr is concentrated, and the processability or the like is impaired. On the other hand, if the cooling rate immediately after solidification of the coating, more specifically, immediately after the production of the Al—Fe—Si-based alloy layer, is too high, the layer reaches a temperature not allowing for migration of Cr before Cr is concentrated in the Al—Fe—Si-based alloy layer formed and separated from the Al—Fe alloy layer in the interfacial alloy layer and further concentrated in the uppermost layer of the Al—Fe—Si-based alloy layer, and a Cr-concentrated layer is not formed. The temperature not allowing for migration of Cr is basically 400° C.

The optimal cooling conditions to obtain an adequate Cr concentration distribution vary depending on the kind of the target steel material, the hot-dip bath components, the temperature of the hot-dip bath, and the like, but the cooling rate after solidification of the coating is, as described above, from 10 to 30° C./sec, preferably from 15 to 30° C./sec, more preferably from 15 to 20° C./sec. Since the temperature not allowing for migration of Cr is basically 400° C., for realizing the desired interfacial alloy layer structure (concentrating Cr) of the present invention, the cooling rate needs to be controlled to fall in the above-described range at least during temperatures until the desired Cr concentrating is completed, in the temperature range from the solidification temperature to 400° C., further to the vicinity of 350° C. If the cooling rate during the temperatures above is less than 10° C./sec, the interfacial alloy layer itself becomes too thick before Cr is concentrated, and other characteristics such as processability are impaired. If the cooling rate during the above-described temperatures exceeds 30° C./sec, separation and formation of the Al—Fe-based alloy layer and the Al—Fe—Si-based alloy layer do not suitably proceed or at least further concentrating of Cr at the uppermost layer in the Al—Fe—Si-based alloy layer separated and formed from the Al—Fe-based alloy layer is not realized.

In the present invention, the discrimination between the Al—Fe-based alloy layer and the Al—Fe—Si-based alloy layer is based on the presence or absence of Si and their discrimination is generally easy, but when the concentration of Si in the Al—Fe-based alloy layer is 2% or less, further 1% or less, this is regarded as being absent of Si.

In the present invention, concentrating Cr at the uppermost layer in the Al—Fe—Si-based alloy layer indicates that a layer where Cr is substantially absent in the Al—Fe—Si-based alloy layer is formed and the thickness of the layer substantially absent of Cr is ¼ or more, preferably ⅓ or more, of the entire thickness of the Al—Fe—Si-based alloy layer or is 0.5 μm or more, preferably 1 μm or more. Here, the layer where Cr is substantially absent in the Al—Fe—Si-based alloy layer can be confirmed by EPMA mapping or elemental analysis such as TEM-EDS.

In the coated steel material of the present invention, as long as the cooling rate after solidification is in the range above, formation of the two-layer structure consisting of the above-described $Al_5Fe_2$ layer and $Al_{3.2}Fe$ layer is considered to proceed in parallel with concentrating of Cr at the uppermost layer part in the Al—Fe—Si-based alloy layer. To form the Al—Fe-based alloy layer as two layers of $Al_5Fe_2$ layer and $Al_{3.2}Fe$ layer when or after forming the Al—Fe-based alloy layer by allowing Fe to push up Si and Cr in the Al—Fe—Si-based alloy layer of the interfacial alloy layer, and to realize concentrating of Cr at the uppermost layer part in the Al—Fe—Si-based alloy layer, whichever may be first completed. In the coated steel material of the present invention, concentrating Cr at the uppermost layer part in the Al—Fe—Si-based alloy layer is essential, and obtaining a two-layer structure of $Al_5Fe_2$ layer and $Al_{3.2}Fe$ layer as the Al—Fe-based alloy layer is preferred, but formation of a two-layer structure of $Al_5Fe_2$ layer and $Al_{3.2}Fe$ layer in the Al—Fe-based alloy layer may be realized before Cr is concentrated at the uppermost layer part in the Al—Fe—Si-based alloy layer.

FIG. 1 shows an optical micrograph of the coated steel material having an interfacial alloy layer belonging to the present invention. According to FIG. 1, it is seen that a coating layer is formed on the steel substrate surface and an interfacial alloy layer is formed between the coating layer and the substrate.

Figure 2:
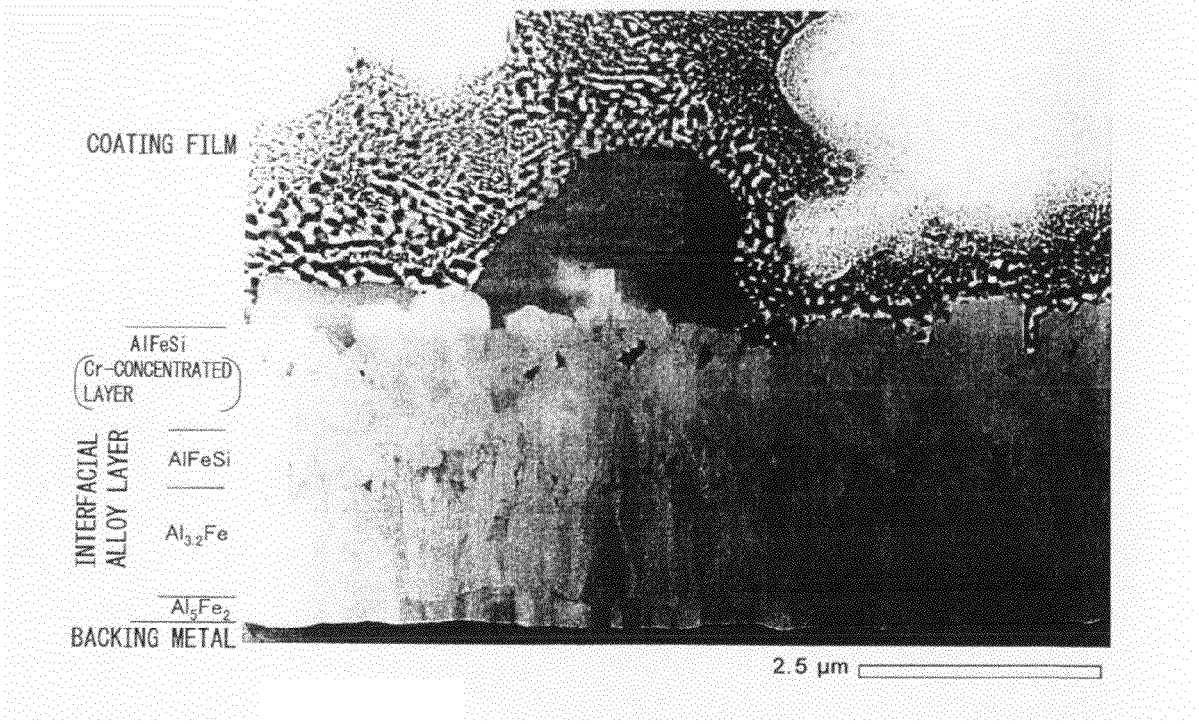
FIG. 2 is an STEM image of the interface neighborhood of the coated steel material of the present invention.

FIG. 2 is an FIB-TEM photograph showing and enlarging a part (the portion indicated in FIG. 1) of the interfacial alloy layer of the coated steel material shown in FIG. 1. The structure of the interfacial alloy layer was determined by performing both a method of obtaining the lattice constant from an electron diffraction image and referring to a literature (for example, JCPDS card) and a method of performing quantitative analysis of elements by EDS and obtaining the constituent ratio of elements. According to FIG. 2, it is recognized that the interfacial alloy layer consists of four layers, that is, $Al_5Fe_2$ layer, $Al_{3.2}Fe$ layer, AlFeSi-based alloy layer and Cr-concentrated AlFeSi layer, in order from the steel substrate side.

Figure 3:
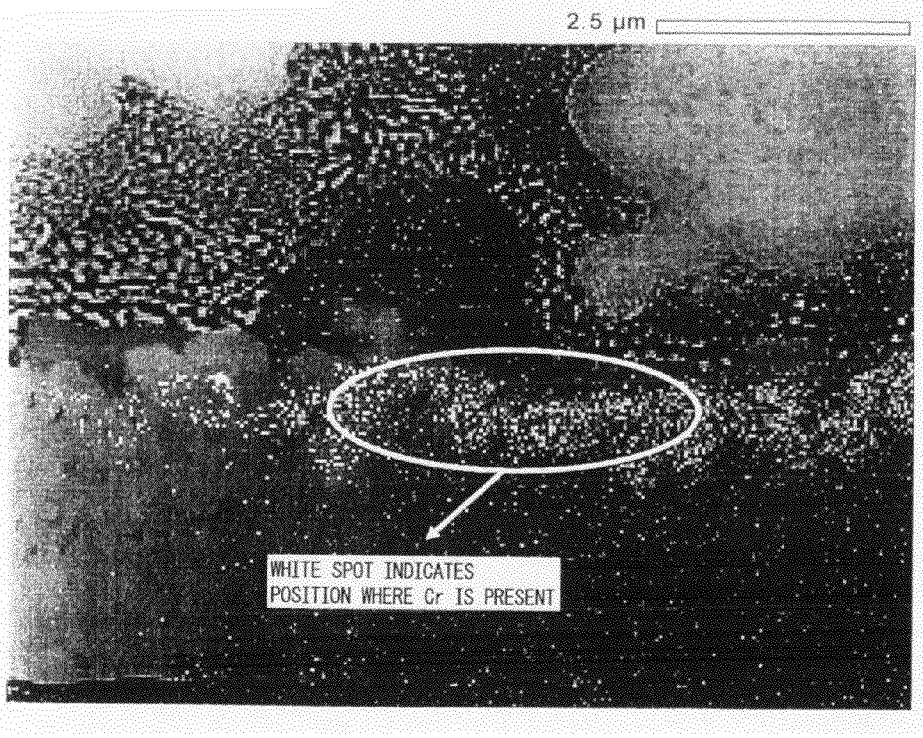
FIG. 3 shows the Cr distribution state (mapping) near the interface of the coated steel material of the present invention.

FIG. 3 shows the results when in a partially enlarged portion of the interfacial alloy layer shown in FIG. 2, Cr was analyzed by FIB-TEM. In FIG. 3, the white spot indicates the presence of Cr and it is recognized that Cr is present in a concentrated manner on the coating layer side of the AlFeSi-based alloy layer and a layer where Cr is substantially absent on the substrate metal side of the AlFeSi-based alloy layer is present.

Figure 4:
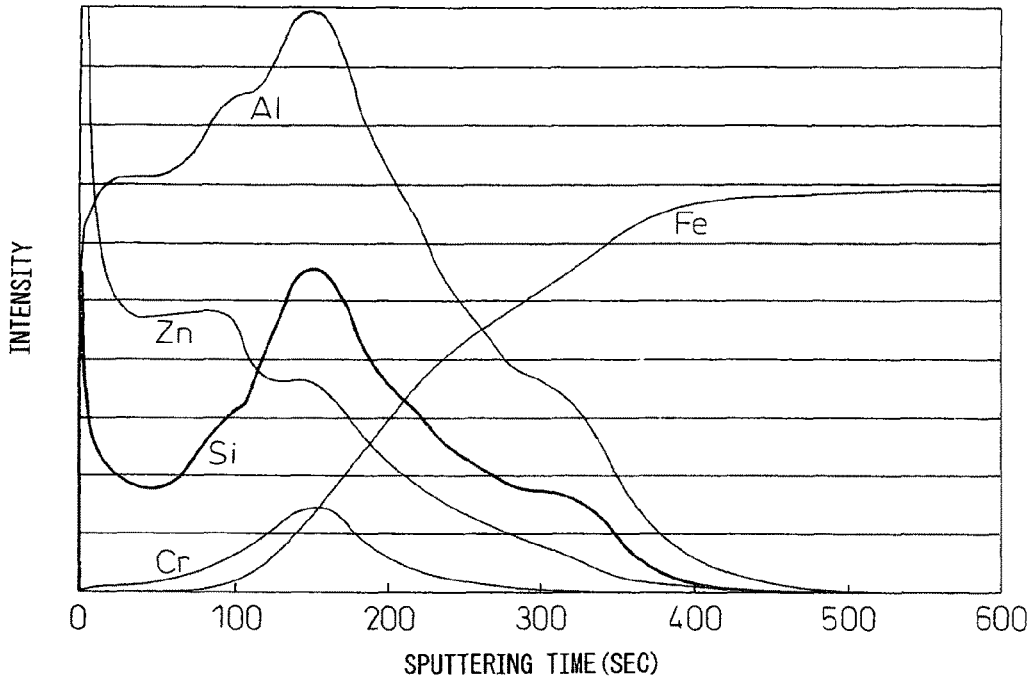
FIG. 4 shows the Cr distribution state (GDS) near the interface of the coated steel material of the present invention.

FIG. 4 shows the GDS results from which the relative positional relationship of Si and Cr is known. Here, GDS is emission spectrometry using a glow discharge tube as the light source. Argon ions generated in the electrode by the discharge are caused to collide with the sample, whereby a sputtering phenomenon occurs. By analyzing the inherent spectrum based on the collision between an atom and an electron jumping out at that time on the sample surface, the kinds of constituent elements can be clarified. Also, the sample is ground down with the passage of discharge time and therefore, analysis in the depth direction from the surface is possible. Accordingly, the GDS results are obtained as the relationship between the discharge time and the inherent spectrum intensity of element. Incidentally, the inherent spectrum intensity is a relative value and does not indicate the absolute content of element and in order to determine the compositional ratio, for example, comparison with a standard sample is necessary. The depth after passing of the final discharge time is known and therefore, the discharge time can be converted into the depth. In FIG. 4 showing the results, the discharge time is shown as the depth (μm) and taken on the X axis and the inherent spectrum intensity is taken on the Y axis. Information about what elements are distributed in the depth direction from the surface, in short, toward the coating side, is obtained.

According to FIG. 4, the rising intensity of Fe reveals the presence of an interfacial layer. Cr is present at the beginning and Al and Si are also simultaneously present. Even after Cr disappears, Al and Si are present. This reveals the presence of an Al—Si—Fe-based alloy layer not containing Cr. Furthermore, even after Si disappears, Al is present, revealing that an Al—Fe alloy layer is present in the final layer. From FIGS. 3 and 4, it is revealed that $Al_5Fe_2$, $Al_{3.2}Fe$ and Al—Fe—Si-based alloy layer are produced at the interface between the coating layer and the steel substrate and Cr is concentrated only on the coating layer side of the Al—Fe—Si-based alloy layer, providing a four-layer structure.

In producing the alloy-coated steel material of the present invention, a known technique of, for example, dipping a steel material working out to a base material in a molten metal bath containing Zn, Al, Cr, Si and Mg in the same blending ratio as in the composition of the desired coating layer, may be used.

Before dipping the steel material in the hot-dip bath, an alkali degreasing treatment and an acid washing treatment may be applied for the purpose of, for example, improving the coating wettability and coating adherence of the steel material to be coated. Also, a flux treatment using zinc chloride, ammonium chloride or other chemicals may be applied. As the method for coating the steel material to be coated, a method of continuously applying steps of heating, reducing and annealing a steel material to be coated by using a non-oxidizing furnace a reduction furnace or a total reducing furnace, dipping and pulling the steel material in and out of the hot-dip bath, performing control to the predetermined coating coverage by a gas wiping system, and cooling the steel material, may be used.

As for the method of preparing the coating bath, an alloy previously prepared to have a composition falling in the range specified in the present invention may be heated and melted, or a method of heating and melting respective metal elements or two or more kinds of alloys in combination to obtain a predetermined composition may be applied. As the heating and melting method, a method of directly melting metals or alloys in a coating pot may be used, or a method of previously melting them in a pre-melting furnace and then transferring the melt to a coating pot may be used. The method using a pre-melting furnace may involve a high cost for equipment installation but is advantageous in that, for example, removal of impurities such as dross generated when melting the coating alloy is facilitated or the temperature of the coating bath is easily controlled.

For the purpose of reducing the generation of oxide dross that is formed due to contact of the coating bath surface with air, the coating bath surface may be covered with a heat-resistant material such as ceramic and glass wool.

The method for achieving the cooling conditions is basically a forced cooling in both between dipping of the steel material in the molten metal bath and solidification of the coating layer and between solidification temperature of the coating layer and realization of the desired Cr concentrating. The specific method therefor is not particularly limited and those cooling methods may be the same or different, but a forced cooling method by spraying of coolant gas or mist is simple and easy. The coolant gas is preferably an inert gas such as nitrogen and rare gas.

Figure 5:
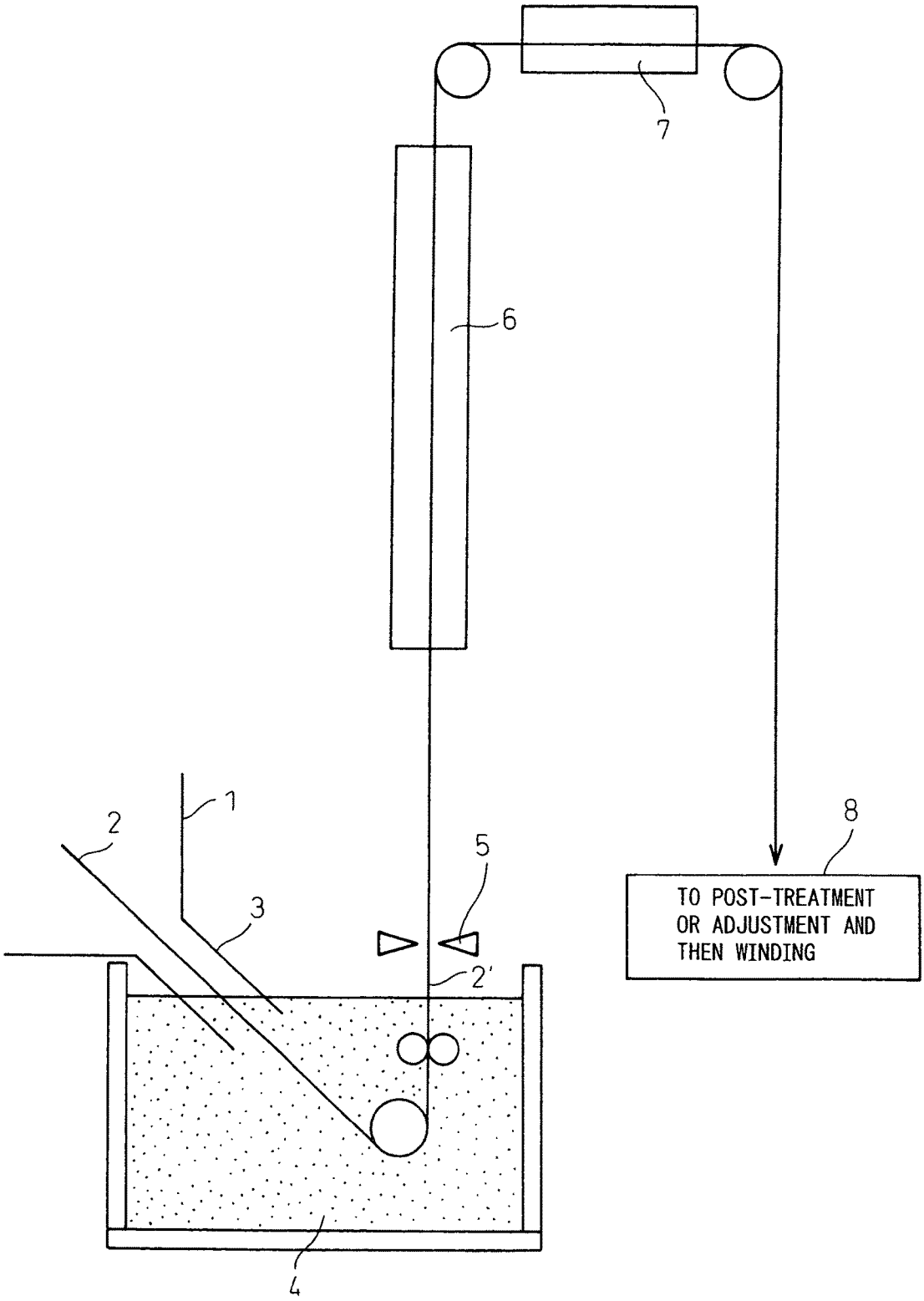
FIG. 5 shows the coating forming method for the coated steel material of the present invention.

FIG. 5 shows an example of the coating forming method according to the present invention. Referring to FIG. 5, for example, a steel material 2 annealed in a reduction annealing furnace 1 is introduced into a hot-dip bath 4 through a snout 3, and the steel material 2 is dipped in the hot-dip bath 4 having a predetermined coating composition. In the steel material 2' pulled out of the hot-dip bath 4, an excessive hot-dip coating bath is attached to the surface and therefore, the coverage is adjusted by gas wiping 5. After a coating layer is formed through cooling in cooling zones 6 and 7, the steel material is post-treated or adjusted and transferred to a winding 8. The method of the present invention is characterized in that the steel material 2' pulled out of the hot-dip bath 4 is forcedly cooled under specific conditions by using the cooling zones 6 and 7, and the cooling is performed under predetermined cooling conditions specified in the present invention in terms of temperature ranges between dipping in the coating bath and solidification of the coating and between solidification of the coating and the predetermined temperature. The cooling method in the cooling zones 6 and 7 is not particularly limited and may be, for example, either forced air cooling or air-water cooling, and the number of cooling zones and the position of the cooling zone are also not limited.

Furthermore, when a resin-based coating material such as polyester resin-based, acrylic resin-based, fluororesin-based, vinyl chloride resin-based, urethane resin-based and epoxy resin-based is applied to the surface of the molten Zn—Al—Mg—Si—Cr alloy-coated steel material of the present invention by, for example, roll coating, spray coating, curtain flow coating, dip coating or a method such as film lamination when stacking a plastic film such as acrylic resin film and a coating film is thereby formed, excellent corrosion resistance can be exerted in the flat part, cut end face part and bending processed part under a corrosive atmosphere.

The Zn—Al—Mg—Si—Cr alloy-coated steel material produced in this way can be used as a steel material having corrosion resistance surpassing that of conventional alloy-coated steel materials, for building materials and automobiles.

EXAMPLES

The present invention is described in greater detail below by referring to Examples.

Example 1

Using coating equipment shown in FIG. 5, a cold-rolled steel sheet having a sheet thickness of 0.8 mm (SPCC) (JIS G3141) was degreased, subjected to a heating reduction treatment at 800° C. for 60 seconds in an $N_2$—$H_2$ atmosphere based on a hot-dip coating simulator manufactured by Rhesca Co., Ltd., cooled to the coating bath temperature and then coated under the conditions (coating bath composition, bath temperature, dipping time, cooling rate until solidification, cooling rate after solidification) shown in Tables 1 to 6 to produce an alloy-coated steel material. The coating coverage was set to 60 g/m$^2$ on one surface.

The method for cooling the coating was performed by spraying $N_2$ gas or spraying mist composed of $N_2$ gas and $H_2O$ in the cooling zones 6 and 7 in FIG. 5.

The obtained alloy-coated steel material was cut into 100 mm×50 mm and tested for corrosion resistance evaluation. The end face and back surface were protected with a transparent seal, and only the front surface was evaluated. In the evaluation of corrosion resistance, a salt spray test (JIS Z 2371) was performed, and the corrosion resistance was evaluated by the time until generation of red rust (bare corrosion resistance).

A: The time until generation of red rust is 1,440 hours or more.

B: The time until generation of red rust is from 1,200 hours to less than 1,440 hours.

C: The time until generation of red rust is from 960 hours to less than 1,200 hours.

D: The time until generation of red rust is less than 960 hours.

As for the characteristics of the bending processed part, the alloy-coated steel material was cut into 60 mm×30 mm, bent at 90° and subjected to the same salt spray test (JIS Z 2371) as above, and the corrosion resistance was evaluated by the time until generation of red rust. The surface evaluated was the outside surface of the bent portion (corrosion resistance of processed part).

A: The time until generation of red rust is 1,200 hours or more.

C: The time until generation of red rust is from 720 hours to less than 1,200 hours.

D: The time until generation of red rust is less than 720 hours.

Separately, the cross-section was observed by TEM to inspect the condition of the interfacial alloy layer, and the thickness and Cr distribution state of the alloy layer were examined (thickness of alloy layer, condition of interfacial alloy layer).

A: The interfacial alloy layer is formed as a four-layer structure (four layers of $Al_5Fe_2$ layer, $Al_{3.2}Fe$ layer, AlFeSi-based alloy layer and Cr-concentrated AlFeSi layer).

C: The interfacial alloy layer is formed as a three-layer structure and Cr is widely distributed in the Al—Fe—Si alloy layer (three layers of $Al_5Fe_2$ layer, $Al_{3.2}Fe$ layer and Cr-containing AlFeSi-based alloy layer).

D: The interfacial alloy layer is formed as a single-layer structure mostly composed of an Al—Fe—Si—Cr alloy layer.

Incidentally, as for the Cr amount in the interfacial alloy layer, the Cr amount in the Al—Fe—Si-based alloy layer was determined by quantitative analysis according to the energy dispersive X-ray spectrometry (EDS) (Cr amount in mass % of interfacial alloy layer).

TABLE 1

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 1 | 25.0 | 0.2 | 1.6 | 1.0 | bal. | 500 | 2.0 | 15 | 18 | 0.1 | C | C | C | 0.2 | Invention |
| 2 | 25.0 | 1.0 | 1.6 | 1.0 | bal. | 550 | 2.0 | 15 | 18 | 0.6 | C | C | C | 0.4 | |
| 3 | 45.0 | 0.2 | 1.6 | 1.0 | bal. | 550 | 2.0 | 15 | 18 | 1.0 | C | A | A | 0.4 | |
| 4 | 45.0 | 1.0 | 1.6 | 1.0 | bal. | 580 | 2.0 | 15 | 18 | 2.0 | B | A | A | 0.5 | |
| 5 | 55.0 | 0.2 | 1.6 | 1.0 | bal. | 600 | 2.0 | 15 | 18 | 3.6 | A | A | A | 0.5 | |
| 6 | 55.0 | 1.0 | 1.6 | 1.0 | bal. | 600 | 2.0 | 15 | 18 | 3.6 | A | A | A | 0.6 | |
| 7 | 55.0 | 0.2 | 1.6 | 3.0 | bal. | 600 | 2.0 | 15 | 18 | 3.6 | A | A | A | 0.5 | |
| 8 | 55.0 | 1.0 | 1.6 | 3.0 | bal. | 600 | 2.0 | 15 | 18 | 3.6 | A | A | A | 0.6 | |
| 9 | 60.0 | 0.2 | 1.6 | 3.0 | bal. | 620 | 2.0 | 18 | 18 | 3.0 | B | A | A | 0.4 | |
| 10 | 60.0 | 1.0 | 1.6 | 3.0 | bal. | 620 | 2.0 | 18 | 18 | 3.0 | A | A | A | 0.8 | |
| 11 | 60.0 | 1.0 | 1.0 | 3.0 | bal. | 620 | 2.0 | 18 | 18 | 3.0 | A | A | A | 0.6 | |
| 12 | 60.0 | 1.0 | 1.2 | 3.0 | bal. | 620 | 2.0 | 18 | 18 | 3.0 | A | A | A | 0.7 | |
| 13 | 60.0 | 1.0 | 1.5 | 3.0 | bal. | 620 | 2.0 | 18 | 18 | 3.0 | A | A | A | 0.8 | |
| 14 | 60.0 | 1.0 | 1.6 | 0.1 | bal. | 620 | 2.0 | 18 | 18 | 3.0 | A | A | A | 0.8 | |
| 15 | 60.0 | 1.0 | 1.6 | 0.2 | bal. | 620 | 2.0 | 18 | 18 | 3.0 | A | A | A | 0.8 | |
| 16 | 60.0 | 1.0 | 1.6 | 0.4 | bal. | 620 | 2.0 | 18 | 18 | 3.0 | A | A | A | 0.8 | |
| 17 | 60.0 | 1.0 | 1.6 | 0.6 | bal. | 620 | 2.0 | 18 | 18 | 3.0 | A | A | A | 0.8 | |
| 18 | 60.0 | 1.0 | 1.6 | 0.8 | bal. | 620 | 2.0 | 18 | 18 | 3.0 | A | A | A | 0.8 | |
| 19 | 60.0 | 3.0 | 1.6 | 3.0 | bal. | 620 | 2.0 | 18 | 18 | 3.0 | A | A | A | 1.3 | |
| 20 | 60.0 | 5.0 | 1.6 | 3.0 | bal. | 620 | 2.0 | 18 | 18 | 3.0 | A | A | A | 4.5 | |

TABLE 2

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 21 | 60.0 | 0.2 | 1.6 | 3.0 | bal. | 620 | 3.0 | 10 | 18 | 5.0 | A | A | A | 1.0 | Invention |
| 22 | 60.0 | 1.0 | 1.6 | 3.0 | bal. | 620 | 3.0 | 10 | 18 | 5.0 | A | A | A | 1.8 | |
| 23 | 60.0 | 3.0 | 1.6 | 3.0 | bal. | 620 | 3.0 | 10 | 18 | 5.0 | A | A | A | 6.2 | |
| 24 | 60.0 | 5.0 | 1.6 | 3.0 | bal. | 620 | 3.0 | 10 | 18 | 5.0 | A | A | A | 8.3 | |
| 25 | 60.0 | 0.2 | 1.6 | 3.0 | bal. | 580 | 2.0 | 10 | 18 | 4.2 | B | C | C | 0.8 | |
| 26 | 60.0 | 1.0 | 1.6 | 3.0 | bal. | 580 | 2.0 | 10 | 18 | 4.2 | B | C | C | 1.7 | |
| 27 | 60.0 | 3.0 | 1.6 | 3.0 | bal. | 580 | 2.0 | 10 | 18 | 4.2 | B | C | C | 5.8 | |
| 28 | 60.0 | 5.0 | 1.6 | 3.0 | bal. | 580 | 2.0 | 10 | 18 | 4.2 | B | C | C | 8.0 | |
| 29 | 65.0 | 0.05 | 1.6 | 1.0 | bal. | 630 | 3.0 | 10 | 18 | 5.0 | B | A | A | 0.4 | |
| 30 | 65.0 | 0.2 | 1.6 | 1.0 | bal. | 630 | 3.0 | 15 | 18 | 5.0 | A | A | A | 0.9 | |
| 31 | 65.0 | 1.0 | 1.6 | 1.0 | bal. | 630 | 3.0 | 15 | 18 | 5.0 | A | A | A | 1.9 | |
| 32 | 65.0 | 3.0 | 1.6 | 1.0 | bal. | 630 | 3.0 | 15 | 18 | 5.0 | A | A | A | 6.0 | |
| 33 | 65.0 | 5.0 | 1.6 | 1.0 | bal. | 630 | 3.0 | 15 | 18 | 5.0 | A | A | A | 8.6 | |
| 34 | 65.0 | 0.2 | 1.6 | 3.0 | bal. | 630 | 3.0 | 15 | 18 | 5.0 | A | A | A | 0.8 | |
| 35 | 65.0 | 1.0 | 1.6 | 3.0 | bal. | 630 | 3.0 | 15 | 18 | 5.0 | A | A | A | 1.7 | |
| 36 | 65.0 | 3.0 | 1.6 | 3.0 | bal. | 630 | 3.0 | 15 | 18 | 5.0 | A | A | A | 5.8 | |
| 37 | 65.0 | 5.0 | 1.6 | 3.0 | bal. | 630 | 3.0 | 15 | 18 | 5.0 | A | A | A | 8.0 | |
| 38 | 65.0 | 0.2 | 1.6 | 5.0 | bal. | 630 | 3.0 | 15 | 18 | 5.0 | A | A | A | 1.0 | |
| 39 | 65.0 | 1.0 | 1.6 | 5.0 | bal. | 630 | 3.0 | 17 | 16 | 5.0 | A | A | A | 1.8 | |
| 40 | 65.0 | 3.0 | 1.6 | 5.0 | bal. | 630 | 3.0 | 17 | 16 | 5.0 | A | A | A | 6.3 | |

TABLE 3

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 41 | 65.0 | 5.0 | 1.6 | 5.0 | bal. | 630 | 3.0 | 17 | 16 | 5.0 | A | A | A | 8.8 | Invention |
| 42 | 65.0 | 0.2 | 1.6 | 8.0 | bal. | 630 | 3.0 | 15 | 18 | 5.0 | A | A | A | 0.8 | |
| 43 | 65.0 | 1.0 | 1.6 | 8.0 | bal. | 630 | 3.0 | 15 | 18 | 5.0 | A | A | A | 1.7 | |
| 44 | 65.0 | 3.0 | 1.6 | 8.0 | bal. | 630 | 3.0 | 15 | 18 | 5.0 | A | A | A | 5.8 | |
| 45 | 65.0 | 5.0 | 1.6 | 8.0 | bal. | 630 | 3.0 | 15 | 18 | 5.0 | A | A | A | 8.0 | |

TABLE 3-continued

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 46 | 65.0 | 0.2 | 1.6 | 10.0 | bal. | 630 | 3.0 | 15 | 18 | 5.0 | A | A | A | 1.1 | |
| 47 | 65.0 | 1.0 | 1.6 | 10.0 | bal. | 630 | 3.0 | 15 | 18 | 5.0 | A | A | A | 1.9 | |
| 48 | 65.0 | 3.0 | 1.6 | 10.0 | bal. | 630 | 3.0 | 15 | 18 | 5.0 | A | A | A | 5.7 | |
| 49 | 65.0 | 5.0 | 1.6 | 10.0 | bal. | 630 | 3.0 | 15 | 18 | 5.0 | A | A | A | 9.0 | |
| 50 | 65.0 | 0.2 | 3.0 | 3.0 | bal. | 630 | 3.0 | 15 | 18 | 5.0 | A | A | A | 1.3 | |
| 51 | 65.0 | 1.0 | 3.0 | 3.0 | bal. | 630 | 3.0 | 15 | 18 | 5.0 | A | A | A | 2.5 | |
| 52 | 65.0 | 3.0 | 3.0 | 3.0 | bal. | 630 | 3.0 | 15 | 18 | 5.0 | A | A | A | 5.5 | |
| 53 | 65.0 | 5.0 | 3.0 | 3.0 | bal. | 630 | 3.0 | 15 | 18 | 5.0 | A | A | A | 8.0 | |
| 54 | 65.0 | 0.2 | 7.5 | 3.0 | bal. | 630 | 3.0 | 15 | 18 | 5.0 | A | A | A | 1.5 | |
| 55 | 65.0 | 1.0 | 7.5 | 3.0 | bal. | 630 | 3.0 | 15 | 18 | 5.0 | A | A | A | 2.8 | |
| 56 | 65.0 | 3.0 | 7.5 | 3.0 | bal. | 630 | 3.0 | 15 | 18 | 5.0 | A | A | A | 6.0 | |
| 57 | 65.0 | 5.0 | 7.5 | 3.0 | bal. | 630 | 3.0 | 15 | 18 | 5.0 | A | A | A | 9.2 | |
| 58 | 65.0 | 0.2 | 1.6 | 3.0 | bal. | 660 | 3.0 | 18 | 18 | 5.0 | A | A | A | 0.8 | |
| 59 | 65.0 | 1.0 | 1.6 | 3.0 | bal. | 660 | 3.0 | 18 | 18 | 5.0 | A | A | A | 1.7 | |
| 60 | 65.0 | 3.0 | 1.6 | 3.0 | bal. | 660 | 3.0 | 18 | 18 | 5.0 | A | A | A | 6.0 | |

TABLE 4

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 61 | 65.0 | 5.0 | 1.6 | 3.0 | bal. | 660 | 3.0 | 18 | 18 | 5.0 | A | A | A | 8.0 | Invention |
| 62 | 65.0 | 0.2 | 1.6 | 3.0 | bal. | 660 | 3.0 | 18 | 18 | 5.0 | A | A | A | 0.8 | |
| 63 | 65.0 | 1.0 | 1.6 | 3.0 | bal. | 660 | 3.0 | 18 | 18 | 5.0 | A | A | A | 1.9 | |
| 64 | 65.0 | 3.0 | 1.6 | 3.0 | bal. | 660 | 3.0 | 18 | 18 | 5.0 | A | A | A | 5.8 | |
| 65 | 65.0 | 5.0 | 1.6 | 3.0 | bal. | 660 | 3.0 | 18 | 18 | 5.0 | A | A | A | 8.0 | |
| 66 | 70.0 | 0.2 | 1.6 | 1.0 | bal. | 650 | 3.0 | 15 | 18 | 5.0 | A | A | A | 0.8 | |
| 67 | 70.0 | 1.0 | 1.6 | 1.0 | bal. | 650 | 3.0 | 15 | 18 | 5.0 | A | A | A | 1.7 | |
| 68 | 70.0 | 3.0 | 1.6 | 1.0 | bal. | 650 | 3.0 | 15 | 18 | 5.0 | A | A | A | 5.8 | |
| 69 | 70.0 | 5.0 | 1.6 | 1.0 | bal. | 650 | 3.0 | 15 | 18 | 5.0 | A | A | A | 8.0 | |
| 70 | 70.0 | 0.2 | 1.6 | 3.0 | bal. | 650 | 3.0 | 15 | 18 | 5.0 | A | A | A | 0.8 | |
| 71 | 70.0 | 1.0 | 1.6 | 3.0 | bal. | 650 | 3.0 | 15 | 18 | 5.0 | A | A | A | 1.7 | |
| 72 | 70.0 | 3.0 | 1.6 | 3.0 | bal. | 650 | 3.0 | 15 | 18 | 5.0 | A | A | A | 5.8 | |
| 73 | 70.0 | 5.0 | 1.6 | 3.0 | bal. | 650 | 3.0 | 15 | 18 | 5.0 | A | A | A | 8.0 | |
| 74 | 75.0 | 0.2 | 1.6 | 3.0 | bal. | 680 | 3.0 | 18 | 18 | 5.0 | A | A | A | 1.6 | |
| 75 | 75.0 | 1.0 | 1.6 | 3.0 | bal. | 680 | 3.0 | 18 | 18 | 5.0 | A | A | A | 2.5 | |
| 76 | 75.0 | 3.0 | 1.6 | 3.0 | bal. | 680 | 3.0 | 18 | 18 | 5.0 | A | A | A | 7.0 | |
| 77 | 75.0 | 5.0 | 1.6 | 3.0 | bal. | 680 | 3.0 | 18 | 18 | 5.0 | A | A | A | 9.5 | |
| 78 | 65.0 | 0.2 | 1.6 | 3.0 | bal. | 630 | 3.0 | 15 | 25 | 4.6 | A | C | A | 0.6 | |
| 79 | 65.0 | 1.0 | 1.6 | 3.0 | bal. | 630 | 3.0 | 15 | 25 | 4.4 | A | C | A | 1.5 | |
| 80 | 65.0 | 3.0 | 1.6 | 3.0 | bal. | 630 | 3.0 | 15 | 25 | 4.6 | A | C | A | 5.0 | |

TABLE 5

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 81 | 65.0 | 0.2 | 1.6 | 3.0 | bal. | 630 | 3.0 | 15 | 10 | 6.1 | A | C | C | 1.5 | Invention |
| 82 | 65.0 | 1.0 | 1.6 | 3.0 | bal. | 630 | 3.0 | 15 | 10 | 6.1 | A | C | C | 2.3 | |
| 83 | 65.0 | 3.0 | 1.6 | 3.0 | bal. | 630 | 3.0 | 15 | 10 | 6.1 | A | C | C | 6.5 | |
| 84 | 60.0 | 1.0 | 1.6 | 3.0 | bal. | 620 | 3.0 | 10 | 18 | 5.0 | A | A | A | 1.8 | |
| 85 | 65.0 | 1.0 | 1.6 | 3.0 | bal. | 630 | 3.0 | 15 | 18 | 5.0 | A | A | A | 1.7 | |
| 86 | 45.0 | 0.2 | 1.6 | 1.0 | bal. | 550 | 2.0 | 15 | 18 | 1.0 | A | A | A | 0.5 | |
| 87 | 45.0 | 0.2 | 1.6 | 1.0 | bal. | 550 | 2.0 | 15 | 18 | 1.0 | A | A | A | 0.5 | |
| 88 | 65.0 | 0.2 | 1.6 | 3.0 | bal. | 630 | 3.0 | 15 | 15 | 5.5 | A | A | A | 1.2 | |
| 89 | 65.0 | 0.2 | 1.6 | 3.0 | bal. | 630 | 3.0 | 15 | 20 | 4.5 | A | A | A | 1.2 | |
| 90 | 65.0 | 0.2 | 1.6 | 3.0 | bal. | 630 | 3.0 | 15 | 25 | 4.0 | A | C | A | 1.4 | |

TABLE 5-continued

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 91 | 65.0 | 0.2 | 1.6 | 3.0 | bal. | 630 | 3.0 | 15 | 28 | 3.4 | A | C | A | 1.5 | |
| 92 | 65.0 | 0.2 | 1.6 | 3.0 | bal. | 630 | 3.0 | 15 | 30 | 2.9 | A | C | C | 1.3 | |
| 93 | 65.0 | 0.2 | 1.6 | 3.0 | bal. | 630 | 3.0 | 10 | 18 | 8.0 | A | A | A | 1.5 | |
| 94 | 65.0 | 0.2 | 1.6 | 3.0 | bal. | 630 | 3.0 | 12 | 18 | 6.1 | A | A | A | 1.5 | |
| 95 | 65.0 | 0.2 | 1.6 | 3.0 | bal. | 630 | 3.0 | 20 | 18 | 4.2 | A | A | A | 1.4 | |
| 96 | 60.0 | 1.0 | 1.6 | 3.0 | bal. | 600 | 2.0 | 18 | 10 | 6.0 | A | C | A | 1.0 | |
| 97 | 60.0 | 1.0 | 1.6 | 3.0 | bal. | 600 | 2.0 | 18 | 15 | 4.0 | A | A | A | 1.0 | |
| 98 | 60.0 | 1.0 | 1.6 | 3.0 | bal. | 600 | 2.0 | 18 | 20 | 3.0 | A | A | A | 1.1 | |
| 99 | 60.0 | 1.0 | 1.6 | 3.0 | bal. | 600 | 2.0 | 18 | 25 | 2.6 | A | C | A | 1.2 | |
| 100 | 60.0 | 1.0 | 1.6 | 3.0 | bal. | 600 | 2.0 | 18 | 30 | 2.1 | A | C | C | 1.3 | |

TABLE 6

| | Composition of Coating Layer (mass %) | | | | | Bath Temperature | Dipping Time | Cooling Rate Until Solidification | Cooling Rate After Solidification | Thickness of Alloy Layer | Bare Corrosion | Corrosion Resistance of Processed | Condition of Interfacial Alloy | Cr Amount of Interfacial Alloy | |
|---|---|---|---|---|---|---|---|---|---|---|---|---|---|---|---|
| | Al | Cr | Si | Mg | Zn | ° C. | (sec) | (° C./sec) | (° C./sec) | (μm) | Resistance | Part | Layer | Layer | Remarks |
| 101 | 55.0 | 0.0 | 1.6 | 0.0 | bal. | 600 | 2.0 | 10 | 10 | 4.0 | D | D | D | 0 | Comparative |
| 102 | 55.0 | 1.0 | 0.8 | 3.0 | bal. | 600 | 2.0 | 15 | 15 | 3.6 | D | D | D | 0.2 | Example |
| 103 | 55.0 | 0.01 | 1.6 | 3.0 | bal. | 600 | 2.0 | 15 | 15 | 3.2 | D | D | D | 0 | |
| 104 | 55.0 | 1.0 | 1.6 | 0.05 | bal. | 600 | 2.0 | 15 | 15 | 3.0 | D | C | A | 1.2 | |
| 105 | 55.0 | 1.0 | 1.6 | 3.0 | bal. | 630 | 8.0 | 8 | 8 | 13.5 | D | D | D | 0.3 | |
| 106 | 65.0 | 1.0 | 1.6 | 1.0 | bal. | 630 | 2.0 | 30 | 30 | 0.6 | D | D | D | 0.2 | |
| 107 | 65.0 | 1.0 | 1.6 | 3.0 | bal. | 630 | 2.0 | 30 | 30 | 0.6 | D | D | D | 0.2 | |
| 108 | 65.0 | 1.0 | 1.6 | 1.0 | bal. | 630 | 2.0 | 30 | 30 | 0.6 | D | D | D | 0.2 | |
| 109 | 65.0 | 1.0 | 1.6 | 3.0 | bal. | 630 | 2.0 | 30 | 30 | 0.6 | D | D | D | 0.2 | |
| 110 | 65.0 | 1.0 | 1.6 | 3.0 | bal. | 630 | 3.0 | 40 | 40 | 0.2 | D | D | D | 0.2 | |
| 111 | 65.0 | 1.0 | 1.6 | 3.0 | bal. | 630 | 3.0 | 5 | 12 | 6.5 | D | D | D | 0.2 | |
| 112 | 20.0 | 1.0 | 1.2 | 3.0 | bal. | 500 | 2.0 | 15 | 15 | 0.2 | D | C | A | 0.8 | |
| 113 | 20.0 | 1.0 | 1.2 | 3.0 | bal. | 550 | 2.0 | 15 | 15 | 0.6 | D | C | A | 0.9 | |
| 114 | 65.0 | 0.2 | 1.6 | 3.0 | bal. | 630 | 3.0 | 5 | 18 | 6.0 | B | D | D | 0.8 | |
| 115 | 65.0 | 0.2 | 1.6 | 3.0 | bal. | 630 | 3.0 | 30 | 18 | 3.3 | B | D | D | 0.8 | |
| 116 | 65.0 | 0.2 | 1.6 | 3.0 | bal. | 630 | 3.0 | 15 | 5 | 11.5 | B | D | D | 0.8 | |
| 117 | 65.0 | 0.2 | 1.6 | 3.0 | bal. | 630 | 3.0 | 15 | 40 | 0.8 | B | D | D | 0.8 | |
| 118 | 60.0 | 1.0 | 1.6 | 3.0 | bal. | 600 | 2.0 | 18 | 5 | 11.1 | B | D | D | 1.0 | |
| 119 | 60.0 | 1.0 | 1.6 | 3.0 | bal. | 600 | 2.0 | 18 | 40 | 0.9 | B | D | D | 1.0 | |
| 120 | 60.0 | 1.0 | 1.6 | 3.0 | bal. | 600 | 2.0 | 30 | 18 | 3.0 | B | D | D | 1.0 | |

No. 84 and No. 85: 50 ppm of Sr was added to coating, No. 86: 250 ppm of Sr was added to coating, and No. 87: 500 ppm of Ca was added to coating.

The results are shown in Tables 1 to 6. It is confirmed from these results that by applying alloy coating according to the present invention, the corrosion resistance can be greatly enhanced and an excellent coated steel material can be produced.

The invention claimed is:

1. A hot-dip Zn—Al—Mg—Si—Cr alloy-coated steel material having a coating layer on the surface of a steel material and having an interfacial alloy layer at the interface between said steel material and said coating layer, wherein the average composition of the entire coating layer consisting of said coating layer and said interfacial alloy layer contains, in mass %, Al: from 25 to 75%, Mg: from 0.1 to 10%, Si: more than 1% and 7.5% or less, and Cr: from 0.05 to 5.0%, with the balance being Zn and unavoidable impurities, wherein said interfacial alloy layer is composed of coating layer components and Fe and has a thickness of 0.05 to 10 μm or a thickness of 50% or less of the entire coating layer thickness, wherein said interfacial alloy layer has a multilayer structure consisting of an Al—Fe-based alloy layer and an Al—Fe—Si-based alloy layer, wherein said Al—Fe-based alloy layer contains Al, Fe, less than 2 mass % of Si and 0 mass % of Cr, wherein said Al—Fe—Si-based alloy layer contains Al, Fe, 2 mass % or more of Si and Cr, and wherein said Al—Fe—Si-based alloy layer consists of a layer containing Al, Fe, 2 mass % or more of Si and Cr and a layer containing Al, Fe, 2 mass % or more of Si and 0 mass % of Cr, and wherein the layer containing Al, Fe, 2 mass % or more of Si and Cr is in contact with the coating layer.

2. The hot-dip Zn—Al—Mg—Si—Cr alloy-coated steel material as claimed in claim 1, wherein the Cr concentration in said Cr-containing Al—Fe—Si-based alloy layer is from 0.5 to 10% in terms of mass %.

3. The hot-dip Zn—Al—Mg—Si—Cr alloy-coated steel material as claimed in claim 1, wherein said entire coating layer contains, in mass %, from 1 to 500 ppm of at least one of Sr or Ca.

4. A method for producing the hot-dip Zn—Al—Mg—Si—Cr alloy-coated steel material claimed in claim 1, comprising steps of:

(i) dipping and then pulling a steel material in and out of a hot-dip coating bath containing, in mass %, Al: from 25 to 75%, Mg: from 0.1 to 10%, Si: more than 1% and 7.5% or less, and Cr: from 0.05 to 5.0%, with the balance being Zn, to obtain a coated steel material, (ii) cooling the coated steel material obtained in step (i) from the coating bath temperature to the solidification temperature of the coating at a cooling rate of 10 to 18° C./sec to solidify said coating, and (iii) cooling the coated steel material obtained in step (ii) at a cooling rate of 10 to 20° C./sec to form an Al—Fe—Si-based alloy layer containing said Cr in said interfacial alloy layer formed between said steel material and said coating layer.

5. The method according to claim 4, wherein the cooling rate of step (ii) is 10 to 17° C./sec.

6. The method according to claim 4, wherein the cooling rate of step (iii) is 10 to 18° C./sec.

7. The method according to claim 4, wherein the cooling rate of step (iii) is 10 to 16° C./sec.

8. A hot-dip Zn—Al—Mg—Si—Cr alloy-coated steel material having a coating layer on the surface of a steel material and having an interfacial alloy layer at the interface between said steel material and said coating layer, wherein the average composition of the entire coating layer consisting of said coating layer and said interfacial alloy layer contains, in mass %, Al: from 25 to 75%, Mg: from 0.1 to 10%, Si: more than 1% and 7.5% or less, and Cr: from 0.05 to 5.0%, with the balance being Zn and unavoidable impurities, said interfacial alloy layer is composed of coating layer components and Fe and has a thickness of 0.05 to 10 μm or a thickness of 50% or less of the entire coating layer thickness, said interfacial alloy layer has a multilayer structure consisting of an Al—Fe-based alloy layer and an Al—Fe—Si-based alloy layer, and said Al—Fe—Si-based alloy layer contains Cr, wherein said Al—Fe-based alloy layer forms a columnar crystal and said Al—Fe—Si-based alloy layer forms a granular crystal.

9. The hot-dip Zn—Al—Mg—Si—Cr alloy-coated steel material as claimed in claim 8, wherein the Cr concentration in said Cr-containing Al—Fe—Si-based alloy layer is from 0.5 to 10% in terms of mass %.

10. The hot-dip Zn—Al—Mg—Si—Cr alloy-coated steel material as claimed in claim 8, wherein said entire coating layer contains, in mass %, from 1 to 500 ppm of at least one of Sr or Ca.

11. A method for producing the hot-dip Zn—Al—Mg—Si—Cr alloy-coated steel material claimed in claim 8, comprising steps of:

(i) dipping and then pulling a steel material in and out of a hot-dip coating bath containing, in mass %, Al: from 25 to 75%, Mg: from 0.1 to 10%, Si: more than 1% and 7.5% or less, and Cr: from 0.05 to 5.0%, with the balance being Zn, to obtain a coated steel material, (ii) cooling the coated steel material obtained in step (i) from the coating bath temperature to the solidification temperature of the coating at a cooling rate of 10 to 18° C./sec to solidify said coating, and (iii) cooling the coated steel material obtained in step (ii) at a cooling rate of 10 to 20° C./sec to form an Al—Fe—Si-based alloy layer containing said Cr in said interfacial alloy layer formed between said steel material and said coating layer.

12. A hot-dip Zn—Al—Mg—Si—Cr alloy-coated steel material having a coating layer on the surface of a steel material and having an interfacial alloy layer at the interface between said steel material and said coating layer, wherein the average composition of the entire coating layer consisting of said coating layer and said interfacial alloy layer contains, in mass %, Al: from 25 to 75%, Mg: from 0.1 to 10%, Si: more than 1% and 7.5% or less, and Cr: from 0.05 to 5.0%, with the balance being Zn and unavoidable impurities, said interfacial alloy layer is composed of coating layer components and Fe and has a thickness of 0.05 to 10 pm or a thickness of 50% or less of the entire coating layer thickness, said interfacial alloy layer has a multilayer structure consisting of an Al—Fe-based alloy layer and an Al—Fe—Si-based alloy layer, and said Al—Fe—Si-based alloy layer contains Cr, wherein said Al—Fe-based alloy layer consists of a layer composed of $Al_5Fe_2$ and a layer composed of $Al_{3.2}Fe$.

13. The hot-dip Zn—Al—Mg—Si—Cr alloy-coated steel material as claimed in claim 12, wherein the Cr concentration in said Cr-containing Al—Fe—Si-based alloy layer is from 0.5 to 10% in terms of mass %.

14. The hot-dip Zn—Al—Mg—Si—Cr alloy-coated steel material as claimed in claim 12, wherein said entire coating layer contains, in mass %, from 1 to 500 ppm of at least one of Sr or Ca.

15. A method for producing the hot-dip Zn—Al—Mg—Si—Cr alloy-coated steel material claimed in claim 12, comprising steps of:

(i) dipping and then pulling a steel material in and out of a hot-dip coating bath containing, in mass %, Al: from 25 to 75%, Mg: from 0.1 to 10%, Si: more than 1% and 7.5% or less, and Cr: from 0.05 to 5.0%, with the balance being Zn, to obtain a coated steel material, (ii) cooling the coated steel material obtained in step (i) from the coating bath temperature to the solidification temperature of the coating at a cooling rate of 10 to 18° C./sec to solidify said coating, and (iii) cooling the coated steel material obtained in step (ii) at a cooling rate of 10 to 20° C./sec to form an Al—Fe—Si-based alloy layer containing said Cr in said interfacial alloy layer formed between said steel material and said coating layer.

* * * * *

UNITED STATES PATENT AND TRADEMARK OFFICE

CERTIFICATE OF CORRECTION

PATENT NO. : 8,911,879 B2
APPLICATION NO. : 13/138175
DATED : December 16, 2014
INVENTOR(S) : Nobuyuki Shimoda et al.

It is certified that error appears in the above-identified patent and that said Letters Patent is hereby corrected as shown below:

Specification

Column 10, line 54-56, change "using a non-oxidizing furnace a reduction furnace or a total reducing furnace," to -- using a non-oxidizing furnace → a reduction furnace or a total reducing furnace, --.

Signed and Sealed this
Twentieth Day of October, 2015

Michelle K. Lee

Michelle K. Lee
*Director of the United States Patent and Trademark Office*